US011920783B2

(12) United States Patent
Park et al.

(10) Patent No.: US 11,920,783 B2
(45) Date of Patent: Mar. 5, 2024

(54) FLAME PORT UNIT STRUCTURE OF COMBUSTION APPARATUS

(71) Applicant: KYUNGDONG NAVIEN CO., LTD., Gyeonggi-do (KR)

(72) Inventors: Jun Kyu Park, Seoul (KR); Sang Hyun Nam, Seoul (KR); Hyun Muk Lim, Seoul (KR); Whee Jun Lim, Seoul (KR)

(73) Assignee: KYUNGDONG NAVIEN CO., LTD, Gyeonggi-do (KR)

( * ) Notice: Subject to any disclaimer, the term of this patent is extended or adjusted under 35 U.S.C. 154(b) by 471 days.

(21) Appl. No.: 17/255,936

(22) PCT Filed: Jun. 7, 2019

(86) PCT No.: PCT/KR2019/006883
§ 371 (c)(1),
(2) Date: Dec. 23, 2020

(87) PCT Pub. No.: WO2020/004829
PCT Pub. Date: Jan. 2, 2020

(65) Prior Publication Data

US 2021/0247067 A1 Aug. 12, 2021

(30) Foreign Application Priority Data

Jun. 29, 2018 (KR) ..... 10-2018-0075134
Apr. 16, 2019 (KR) ..... 10-2019-0044530

(51) Int. Cl.
*F23D 14/02* (2006.01)
*F23D 14/58* (2006.01)
*F23D 14/74* (2006.01)

(52) U.S. Cl.
CPC ..... *F23D 14/586* (2013.01); *F23D 14/02* (2013.01); *F23D 14/74* (2013.01); *F23D 2900/14003* (2013.01)

(58) Field of Classification Search
CPC ..... F23D 14/586; F23D 14/02; F23D 14/74; F23D 2900/14003
(Continued)

(56) References Cited

U.S. PATENT DOCUMENTS 5,318,438 A * 6/1994 Sugahara ..... F23D 14/105 431/278
6,746,236 B2 6/2004 Kuriyama et al.
(Continued)

FOREIGN PATENT DOCUMENTS

CN 101233365 A 7/2008
CN 101603687 A 12/2009
(Continued)

OTHER PUBLICATIONS

Second Office Action for related Japan Patent Application No. 2020-516410, dated Aug. 26, 2021, 6 pages long.
(Continued)

*Primary Examiner* — Avinash A Savani
(74) *Attorney, Agent, or Firm* — McDonald Hopkins LLC

(57) ABSTRACT

A flame port unit structure of a combustion apparatus provided with a plurality of flame ports for forming a flame comprises: a lean flame port unit, as a flame port for jetting lean gas, including a plurality of lean flame ports arranged along a width direction which is perpendicular to the jetting direction of the lean gas; and a rich flame port unit, as a flame port for jetting rich gas, including a pair of rich flame ports provided on both sides of the lean flame port unit with respect to a width direction, wherein the lean flame port unit comprises a first region in which a gap along the width
(Continued)

direction of the lean flame port is formed along a longitudinal direction which is perpendicular to the jetting direction and the width direction, and a second region, provided on both sides along the longitudinal direction of the first region.

16 Claims, 7 Drawing Sheets

(58) Field of Classification Search
USPC ..... 431/354
See application file for complete search history.

(56) References Cited

U.S. PATENT DOCUMENTS

| | | | | |
|---|---|---|---|---|
| 6,786,717 | B2 | 9/2004 | Shimazu et al. | |
| 9,091,436 | B2 | 7/2015 | Homma | |
| 9,115,888 | B2 * | 8/2015 | Wada | F23D 14/46 |
| 9,228,742 | B2 | 1/2016 | Akiyama et al. | |
| 9,927,143 | B2 | 3/2018 | Naitoh et al. | |
| 2003/0143507 | A1 | 7/2003 | Kuriyama et al. | |
| 2003/0148241 | A1 | 8/2003 | Shimazu et al. | |
| 2008/0160467 | A1 | 7/2008 | Shimazu et al. | |
| 2011/0053105 | A1 | 3/2011 | Kim | |
| 2011/0297059 | A1 * | 12/2011 | Shimizu | F23D 14/045 110/299 |
| 2012/0244482 | A1 | 9/2012 | Homma | |
| 2012/0308945 | A1 * | 12/2012 | Wada | F23D 14/46 431/278 |
| 2013/0149653 | A1 | 6/2013 | Fukunishi et al. | |
| 2013/0171576 | A1 | 7/2013 | Akiyama et al. | |
| 2013/0247844 | A1 * | 9/2013 | Cheng | F23D 14/105 122/18.4 |
| 2015/0184849 | A1 | 7/2015 | Akagi et al. | |
| 2015/0253035 | A1 | 9/2015 | Naitoh et al. | |
| 2015/0369478 | A1 * | 12/2015 | Akagi | F23D 14/045 434/354 |
| 2018/0031230 | A1 | 2/2018 | Naitoh et al. | |
| 2020/0278113 | A1 | 9/2020 | Park et al. | |

FOREIGN PATENT DOCUMENTS

| | | | |
|---|---|---|---|
| CN | 101910725 | A | 12/2010 |
| CN | 102338383 | A | 2/2012 |
| CN | 103185339 | A | 7/2013 |
| CN | 103277812 | A | 9/2013 |
| CN | 104033927 | A | 9/2014 |
| JP | H07332618 | A | 12/1995 |
| JP | H0942616 | A | 2/1997 |
| JP | H09042616 | A | 2/1997 |
| JP | 36719222 | B | 9/2003 |
| JP | 2003269705 | A | 9/2003 |
| JP | 2003269707 | A | 9/2003 |
| JP | 2003329220 | A | 11/2003 |
| JP | 2006-170594 | A | 6/2006 |
| JP | 2008-185240 | A | 8/2008 |
| JP | 5300579 | B | 11/2010 |
| JP | 2010261615 | A | 11/2010 |
| JP | 2011-127863 | A | 6/2011 |
| JP | 2011-191037 | A | 9/2011 |
| JP | 2012127595 | A | 7/2012 |
| JP | 2012-202585 | A | 10/2012 |
| JP | 2013-210164 | A | 10/2013 |
| JP | 6174450 | B | 7/2014 |
| JP | 2015166660 | A | 9/2015 |
| KR | 10-20190032062 | A | 3/2019 |

OTHER PUBLICATIONS

Extended European Search Report for related EP Application No. 18857512.0, dated Aug. 11, 2021, 8 pages long.

Office Action of corresponding Japan Patent Application No. 2020-516410, dated Jan. 22, 2021, 6 pages.

Office Action of corresponding Chinese Patent Application No. 201880060782.4, dated May 13, 2021, 9 pages.

Extended European Search Report for related EP Application No. 19826402.0 dated May 19, 2021, 14 pages long.

International Search Report and Written Opinion for International Patent Application No. PCT/KR2019/006883 dated Sep. 4, 2019, 12 pages long.

Office Action issued for the related U.S. Appl. No. 16/647,709, dated Sep. 27, 2022, 41 pages.

Office Action issued for the corresponding Chinese Patent Application No. 201980044100.5, dated Sep. 30, 2022, 19 pages.

Extended European Search Report issued for the related European Patent Application No. 22160970.4, dated Nov. 8, 2022, 9 pages.

* cited by examiner

FLAME PORT UNIT STRUCTURE OF COMBUSTION APPARATUS

CROSS-REFERENCE TO RELATED APPLICATIONS

This application is the US national phase entry of International Patent Application No. PCT/KR2019/006883 filed Jun. 7, 2019, which claims priority to Korean Patent Application Nos. 10-2018-0075134, filed on Jun. 29, 2018, 10-2019-0044530 filed Apr. 16, 2019, all of the above listed applications are herein incorporated by reference.

TECHNICAL FIELD

The present disclosure relates to a flame-hole structure of a combustion apparatus. More particularly, the present disclosure relates to a flame-hole structure of a combustion apparatus including a plurality of flame-holes for forming a flame.

BACKGROUND ART

A gas combustion apparatus refers to an apparatus for burning a supplied fuel gas to generate heat. When the fuel gas is burned in the combustion apparatus, NOx (nitrogen oxide) is generated. NOx not only causes acid rain, but also irritates eyes and a respiratory organ and kills plants. Therefore, NOx is regulated as a main air pollutant. When an air-fuel mixture (hereinafter, referred to as lean gas) with a relatively low fuel ratio is used in the combustion apparatus, NOx emission may be reduced. However, when the lean gas is used, the burning velocity is reduced so that combustion stability is weakened and carbon monoxide (CO) emission is increased.

Accordingly, a lean-rich burner for reducing NOx emission and enhancing the stability of burning has been developed. The lean-rich burner refers to a burner configured such that a rich flame is located in an appropriate position around a lean flame. The rich flame refers to a flame generated when an air-fuel mixture (hereinafter, referred to as rich gas) with a relatively high fuel ratio is burned. In the lean-rich burner, a tertiary flame is formed while unburned fuel of the rich flame reacts with excess air of the lean flame, and therefore the combustion stability of the lean flame may be enhanced. This effect is called a flame stabilizing effect.

FIG. 1 is a schematic plan view illustrating a flame-hole structure of a lean-rich burner in the related art. In FIG. 1, the portions shown by slants represent flames. As illustrated in FIG. 1, the flame-hole structure in the related art includes, around a lean flame-hole 1 for jetting lean gas, rich flame-holes 2 and 3 for jetting rich gas.

However, according to the flame-hole structure illustrated in FIG. 1, with an increase in the number of lean flame-holes 1, a lifting phenomenon occurs due to a lean flame in region A in which the width of the lean flame-hole 1 is decreased, and therefore flame stability is significantly deteriorated. Here, the lifting phenomenon refers to a phenomenon in which the jetting velocity of a fuel gas is higher than the burning velocity of the fuel gas so that a flame rises off from a flame-hole. The lifted flame is unstable and is easily extinguished, or a large amount of carbon monoxide is generated.

Furthermore, in a case where as in region B of FIG. 1, the widths of the rich flame-holes 2 and 3 are not constant and a cut-off portion exists between the rich flame-holes 2 and 3, a flame rises off and becomes unstable.

DISCLOSURE

Technical Problem

The present disclosure has been made to solve the above-mentioned problems occurring in the prior art. An aspect of the present disclosure is to provide a flame-hole structure of a combustion apparatus for reducing NOx emission and improving a flame stabilizing effect by stably maintaining a lean flame and a rich flame.

Technical Solution

A flame-hole structure of a combustion apparatus having a plurality of flame-holes for forming a flame includes a lean flame-hole part having a plurality of lean flame-holes arranged along a width direction perpendicular to a jetting direction of lean gas as flame-holes through which the lean gas is jetted and a rich flame-hole part having a pair of rich flame-holes provided on opposite sides of the lean flame-hole part with respect to the width direction as flame-holes through which rich gas is jetted. The lean flame-hole part includes a first region in which widths of the lean flame-holes along the width direction are constant along a lengthwise direction perpendicular to the jetting direction and the width direction and second regions provided on opposite sides of the first region along the lengthwise direction, the widths of the lean flame-holes along the width direction being narrower in the second regions than in the first region, and the lean flame-hole part and the rich flame-hole part are brought into close contact with each other in at least part of the second regions.

The lean flame-hole part may further include a plurality of lean plates disposed to be spaced apart from each other at a predetermined interval while facing each other along the width direction, and the lean flame-holes may be formed in separation spaces between the lean plates. The rich flame-hole part may further include a plurality of rich plates disposed to be spaced apart from each other at a predetermined interval while facing each other along the width direction, and the rich flame-holes may be formed in separation spaces between the rich plates.

The plurality of lean plates may include a bending portion bent toward the center of the lean flame-hole part along the width direction to form the second regions and lean plate horizontal-portions extending from opposite ends of the bending portion along a direction parallel to the lengthwise direction, and the plurality of rich plates may include a protruding portion protruding toward the bending portion to correspond to the bending portion and rich plate horizontal-portions extending from opposite ends of the protruding portion along the direction parallel to the lengthwise direction.

A protruding portion of a first rich plate located in the innermost position with respect to the width direction among the plurality of rich plates may be brought into close contact with at least part of a bending portion of a first lean plate located in the outermost position with respect to the width direction among the plurality of lean plates.

The protruding portion of the first rich plate may include a first inclined surface and a second inclined surface extending from the adjacent rich plate horizontal-portions so as to be inclined toward the center of the lean flame-hole part along the width direction and a first horizontal surface extending along the direction parallel to the lengthwise direction to connect distal ends of the first inclined surface and the second inclined surface. The bending portion of the first lean plate may include a third inclined surface and a fourth inclined surface extending from the adjacent lean plate horizontal-portions so as to be inclined toward the center of the lean flame-hole part along the width direction and a second horizontal surface extending along the lengthwise direction to connect distal ends of the third inclined surface and the fourth inclined surface. The first horizontal surface may be brought into contact with the second horizontal surface.

A protruding portion of a first rich plate located in the innermost position with respect to the width direction among the plurality of rich plates may be brought into close contact with the entirety of a bending portion of a first lean plate located in the outermost position with respect to the width direction among the plurality of lean plates.

The protruding portion of the first rich plate may include a first inclined surface and a second inclined surface extending from the adjacent rich plate horizontal-portions so as to be inclined toward the center of the lean flame-hole part along the width direction and a first horizontal surface extending along the lengthwise direction to connect distal ends of the first inclined surface and the second inclined surface. The bending portion of the first lean plate may include a third inclined surface and a fourth inclined surface extending from the adjacent lean plate horizontal-portions so as to be inclined toward the center of the lean flame-hole part along the width direction and a second horizontal surface extending along the lengthwise direction to connect distal ends of the third inclined surface and the fourth inclined surface. The first inclined surface may be brought into close contact with the third inclined surface, the second inclined surface may be brought into close contact with the fourth inclined surface, and the first horizontal surface may be brought into close contact with the second horizontal surface.

A reference region may refer to a region defined at an upper end of each of the rich flame-holes by first and second lines that are virtual lines across the rich flame-hole and a pair of rich plates that form part of the rich flame-hole between the first and second lines, and the plurality of rich plates may be designed such that in a region from at least one rich plate horizontal-portion through an adjacent protruding portion of a rich plate to another rich plate horizontal-portion, the sum of amounts of heat transferred to a pair of rich plates that form reference regions having the same size is substantially the same in the reference regions when a flame is generated by the rich gas.

The plurality of rich plates may be designed such that the sum of lengths of upper ends of the pair of rich plates that form the reference regions is substantially the same in the reference regions having the same size.

The flame-hole structure may further include a partitioning part that is formed between a first lean plate located in the outermost position with respect to the width direction among the plurality of lean plates and a first rich plate located in the innermost position with respect to the width direction among the plurality of rich plates and through which the lean gas and the rich gas are not jetted.

Advantageous Effects

According to the present disclosure, the lean flame-hole part and the rich flame-hole part are brought into close contact with each other in at least part of the second region in which the width of the lean flame-hole is relatively narrow. Thus, in the second region, the rich flame may reduce the instability of the lean flame.

In addition, according to the present disclosure, flames are stably maintained in the entire regions of the lean flame-hole and the rich flame-hole. Thus, NOx emission may be reduced, and a flame stabilizing effect may be uniformly achieved.

MODE FOR INVENTION

Figure 1:
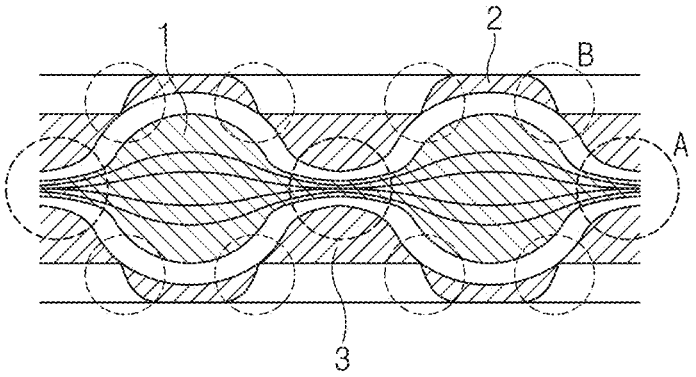
FIG. 1 is a schematic plan view illustrating a flame-hole structure of lean-rich burners in the related art.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

Through repeated experiments and studies for solving the above-mentioned problems, the inventors of the present disclosure have found the cause of the lifting phenomenon in regions A and B of FIG. 1. There may be many causes, and one of them is that part of heat generated when a fuel gas is burned is transferred to the outside so that the burning velocity is reduced. A more specific description will be given with reference to FIG. 2.

Figure 2:
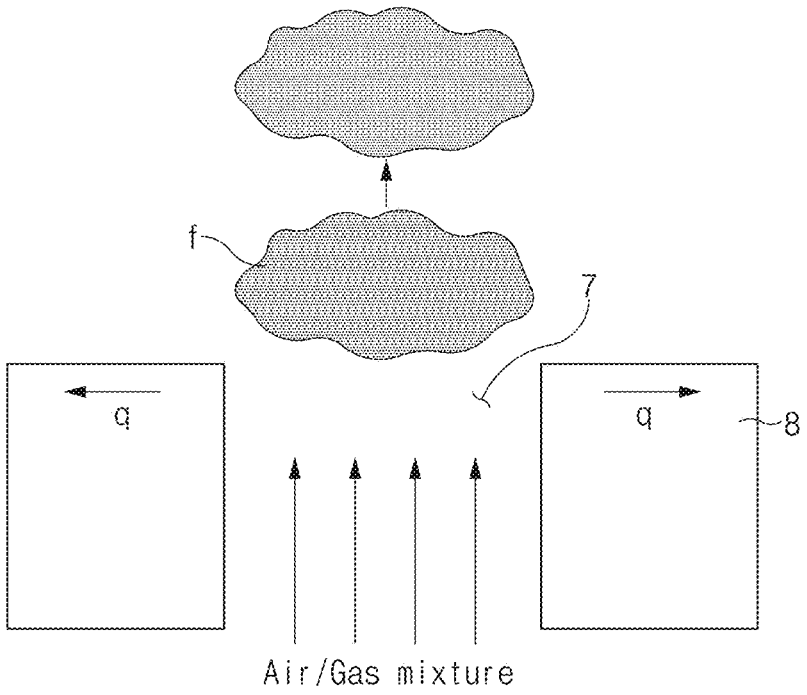
FIG. 2 is a conceptual diagram illustrating a section of a flame-hole structure to describe a lifting phenomenon.

FIG. 2 is a conceptual diagram illustrating a section of a flame-hole structure to describe a lifting phenomenon. As illustrated in FIG. 2, for example, when rich gas jets through a rich flame-hole 7, a rich flame F is generated around a flame-hole wall 8 that forms the rich flame-hole 7. When the amount of heat q transferred to the flame-hole wall 8 increases, the jetting velocity of the rich gas becomes higher than the burning velocity of the rich gas as the burning velocity decreases. Therefore, a problem may arise in which the rich flame F rises off the rich flame-hole 7 and is immediately extinguished.

Even in the case of regions A and B of FIG. 1, in a portion where the width of the lean flame-hole 1 is decreased so that the area of a flame-hole wall making contact with the lean flame is increased and a portion where the rich flame-hole 2 and the rich flame-hole 3 are disconnected from each other, the amount of heat transferred to the flame-hole wall per a unit heating value of lean/rich gas is relatively greater than in other regions. Therefore, a lifting phenomenon may easily occur in regions A and B.

Accordingly, to solve the aforementioned problems, the inventors of the present disclosure have derived flame-hole structures of a combustion apparatus as follows.

Figure 3:
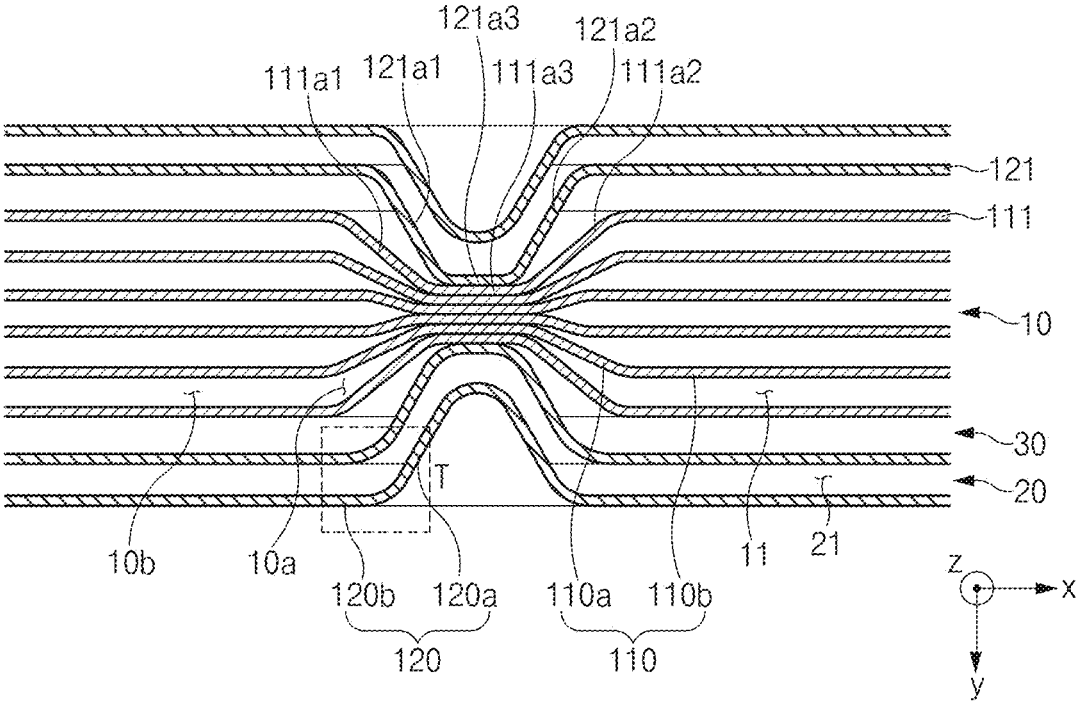
FIG. 3 is a plan view illustrating a flame-hole structure according to an embodiment of the present disclosure.
Figure 4:
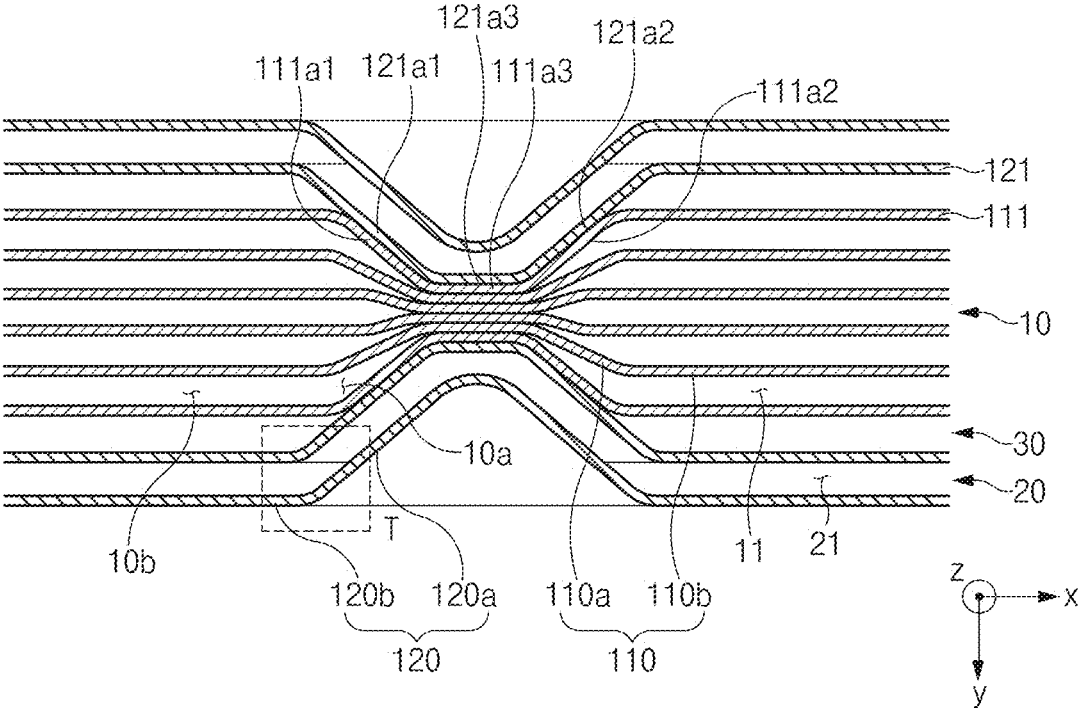
FIG. 4 is a plan view illustrating a flame-hole structure according to another embodiment of the present disclosure.
Figure 5:
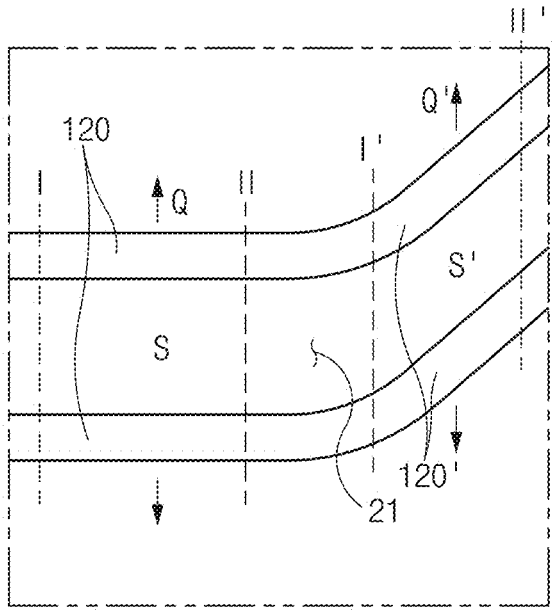
FIG. 5 is a blowup of region T of FIG. 3 or 4.

FIG. 3 is a plan view illustrating a flame-hole structure according to an embodiment of the present disclosure. FIG. 4 is a plan view illustrating a flame-hole structure according to another embodiment of the present disclosure. FIG. 5 is a blowup of region T of FIG. 3 or 4. Hereinafter, the flame-hole structures of a combustion apparatus including a plurality of flame-holes for forming a flame according to an embodiment of the present disclosure will be described with reference to FIGS. 3 to 5.

The flame-hole structure according to the embodiment of the present disclosure includes a lean flame-hole part 10 and a rich flame-hole part 20.

The lean flame-hole part 10 includes a plurality of lean flame-holes 11 through which lean gas is jetted. The plurality of lean flame-holes 11 are arranged along a width direction y that is a direction perpendicular to the jetting direction z of the lean gas. The number of lean flame-holes 11 is not specially limited.

The rich flame-hole part 20 includes a pair of rich flame-holes 21 through which rich gas is jetted. The pair of rich flame-holes 21 are provided on opposite sides of the lean flame-hole part 10 with respect to the width direction y.

The lean gas jetted from the lean flame-holes 11 is burned to form a lean flame, and the rich gas jetted from the rich flame-holes 21 is burned to form a rich flame. As the pair of rich flame-holes 21 are provided on the opposite sides of the lean flame-hole part 10 and surround the lean flame-holes 11, a flame stabilizing effect may occur while the lean flame and the rich flame exchange heat with each other.

The lean flame-hole part 10 includes first regions 10*b* and second regions 10*a*. The first regions 10*b* refer to regions in which the widths of the lean flame-holes 11 along the width direction y are constant along a lengthwise direction x perpendicular to the jetting direction z and the width direction y. Here, "constant" means consistency to a degree that substantially the same action is achieved in the art to which the present disclosure pertains, even though there is a slight numerical difference. The second regions 10*a* refer to regions that are provided on opposite sides of each first region 10*b* along the lengthwise direction x and in which the widths of the lean flame-holes 11 along the width direction y are smaller than those in the first region 10*b*. FIGS. 3 and 4 illustrate parts of the flame-hole structures. Although the first regions 10*b* provided on opposite sides of the second region 10*a* are illustrated, the second region 10*a* may be provided on the non-illustrated side of each first region 10*b*.

The lean flame-hole part 10 and the rich flame-hole part 20 are designed such that a flame stabilizing effect between the lean flame and the rich flame effectively occurs. For example, the lean flame-hole part 10 and the rich flame-hole part 20 are provided to be brought into close contact with each other in at least parts of the second regions 10*a*.

As described above, due to a lifting effect, the lean flame may be unstable in the second regions 10*a* in which the widths of the lean flame-holes 11 along the width direction y are relatively small. However, as the lean flame-hole part 10 and the rich flame-hole part 20 are provided to be brought into close contact with each other in the at least parts of the second regions 10*a*, the distance between the lean flame and the rich flame generated in the second regions 10*a* is decreased so that the rich flame can reduce the instability of the lean flame. As a result, a flame stabilizing effect may stably occur even in the second regions 10*a*.

The lean flame-hole part 10 may further include a plurality of lean plates 110 for forming the lean flame-holes 11, and the rich flame-hole part 20 may further include a plurality of rich plates 120 for forming the rich flame-holes 21.

The plurality of lean plates 110 may be disposed to be spaced apart from each other at predetermined intervals while facing each other along the width direction y. The lean flame-holes 11 may be formed in separation spaces between the lean plates 110. Likewise, the plurality of rich plates 120 may be disposed to be spaced apart from each other at predetermined intervals while facing each other along the width direction y. The rich flame-holes 21 may be formed in separation spaces between the rich plates 120.

The plurality of lean plates 110 may each include bending portions 110*a* and lean plate horizontal-portions 110*b*. The bending portions 110*a* refer to portions bent toward the center of the lean flame-hole part 10 along the width direction y to form the second regions 10*a*. The lean plate horizontal-portions 110*b* refer to portions extending from opposite ends of each bending portion 110*a* along a direction parallel to the lengthwise direction x.

The plurality of rich plates 120 may each include protruding portions 120*a* and rich plate horizontal-portions 120*b*. The protruding portions 120*a* refer to portions protruding toward the bending portions 110*a* to correspond to the bending portions 110*a*. The rich plate horizontal-portions 120*b* refer to portions extending from opposite ends of each protruding portion 120*a* along the direction parallel to the lengthwise direction x.

As described above, FIGS. 3 and 4 illustrate parts of the flame-hole structures. Although opposite ends of each flame-hole structure along the lengthwise direction x are not illustrated, the opposite ends of the flame-hole structure may be finished by the bending portions 110*a* and the protruding portions 120*a*.

Among the plurality of rich plates 120, the rich plates 120 located in the innermost positions with respect to the width direction y are referred to first rich plates 121, and among the plurality of lean plates 110, the lean plates 110 located in the outermost positions with respect to the width direction y are referred to as first lean plates 111. Protruding portions 121*a* of the first rich plates 121 may be brought into close contact with at least parts of bending portions 111*a* of the first lean plates 111. That is, as the protruding portions 121*a* of the first rich plates 121 are brought into close contact with the at least parts of the bending portions 111*a* of the first lean plates 111, the lean flame-hole part 10 and the rich flame-hole part 20 may be brought into close contact with each other in at least parts of the second regions 10*a*.

A more specific description will be given below with reference to FIGS. 3 and 4.

The protruding portions 121*a* of the first rich plates 121 may each include a first inclined surface 121*a*1, a second inclined surface 121*a*2, and a first horizontal surface 121*a*3. The first inclined surface 121*a*1 and the second inclined surface 121*a*2 refer to surfaces extending from the adjacent rich plate horizontal-portions 120*b* so as to be inclined toward the center of the lean flame-hole part 10 along the width direction y, and the first horizontal surface 121*a*3 refers to a surface extending along the direction parallel to the lengthwise direction x to connect distal ends of the first inclined surface 121*a*1 and the second inclined surface 121*a*2.

The bending portions 111*a* of the first lean plates 111 may each include a third inclined surface 111*al*, a fourth inclined surface 111*a*2, and a second horizontal surface 111*a*3. The third inclined surface 111*a*1 and the fourth inclined surface 111*a*2 refer to surfaces extending from the adjacent lean plate horizontal-portions 110*b* so as to be inclined toward the center of the lean flame-hole part 10 along the width direction y, and the second horizontal surface 111*a*3 refers to a surface extending along the direction parallel to the lengthwise direction x to connect distal ends of the third inclined surface 111*a*1 and the fourth inclined surface 111*a*2.

The first horizontal surfaces 121*a*3 may be brought into close contact with the second horizontal surfaces 111*a*3 such that the protruding portions 121*a* of the first rich plates 121 are brought into close contact with at least parts of the bending portions 111*a* of the first lean plates 111. The first inclined surfaces 121*a*1 may be spaced apart from the third inclined surfaces Mal, and the second surfaces 121*a*2 may be spaced apart from the fourth inclined surfaces 111*a*2.

As illustrated in FIG. 3, the lean flame-holes 11 become narrower toward the second horizontal surfaces 111*a*3. Therefore, the lean flame becomes weaker and more unstable with an approach to the second horizontal surfaces 111*a*3. However, the distance between the lean flame-holes 11 and the rich flame-holes 21 is gradually decreased with an approach to the second horizontal surfaces 111*a*3. Accordingly, the rich flame may stabilize the lean flame in a closer position, and thus the stability of the lean flame may be improved.

Alternatively, to allow the protruding portions 121*a* of the first rich plates 121 to be brought into close contact with the entire bending portions 111*a* of the first lean plates 111, as illustrated in FIG. 4, the first inclined surfaces 121*a*1 may be brought into close contact with the third inclined surfaces Mal, the second inclined surfaces 121*a*2 may be brought into close contact with the fourth inclined surfaces 111*a*2, and the first horizontal surfaces 121*a*3 may be brought into close contact with the second horizontal surfaces 111*a*3. Accordingly, in the entire second regions 10*a*, the rich flame may stabilize the unstable lean flame, and the overall flame stabilizing effect may be further improved.

Meanwhile, the plurality of rich plates 120 may be designed such that in a region from at least one rich plate horizontal-portion 120*b* through an adjacent protruding portion 120*a* of a rich plate 120 to another rich plate horizontal-portion 120*b*, the sum of amounts of heat transferred to a pair of rich plates 120 that form reference regions having the same size is substantially the same in the reference regions when a flame is generated by the rich gas.

A more specific description will be given with reference to FIG. 5. First, a reference region S refers to a region defined at an upper end of the rich flame-hole 21 by a first line I, a second line II, and a pair of rich plates 120. The first and second lines I and II are any virtual lines across the rich flame-hole 21, and the rich plates 120 may form part of the rich flame-hole 21 between the first and second lines I and II.

As illustrated in FIG. 5, any reference regions may be defined in the rich flame-hole 21. For example, the reference region S may be defined by the first line I, the second line II, and the pair of rich plates 120, and a reference region S' may be defined by a first line I', a second line II', and a pair of rich plates 120'.

When the reference region S and the reference region S' have the same size, the rich flame-hole 21 includes, between the reference regions, a region designed such that the sum of amounts of heat transferred to the pair of rich plates 120 or 120', that is, the burning velocity of the rich gas in each of the reference regions is substantially the same. In other words, when the reference region S and the reference region S' have the same size, the rich flame-hole 21 includes a region designed such that the sum Q of amounts of heat transferred to the pair of rich plates 120 in the reference region S and the sum Q' of amounts of heat transferred to the pair of rich plates 120' in the reference region S' are substantially the same as each other when a flame is generated by the rich gas.

The same amount of rich gas may be jetted at substantially the same jetting velocity from the reference regions S and S' having the same size, and substantially the same amount of heat may be generated when the rich gas is burned. Further, when the amounts of heat transferred from the reference regions S and S' to the rich plates 120 and 120' are substantially the same, the burning velocities of the rich gas in the reference regions S and S' may also be substantially the same, and therefore limit conditions in which lifting occurs in the reference regions S and S' may be the same. Accordingly, when the rich gas is supplied to the reference regions S and S' in an optimal condition capable of reducing NOx emission, rich flames having substantially the same property may be generated in the reference regions S and S'.

Thus, unlike in the region B of FIG. 1, substantially the same flame stabilizing effect may be obtained in the entirety of the region designed as described above. Accordingly, the flame-hole structures according to the present disclosure may reduce NOx emission and may enhance the stability of burning, thereby allowing a flame stabilizing effect to uniformly occur. The entire region of the rich flame-hole 21 may be designed as described above.

Meanwhile, "substantially the same" does not mean "numerically exactly the same", but means the sameness to a degree that substantially the same action is achieved in the art to which the present disclosure pertains, even though there is a slight numerical difference.

There may be various means for adjusting the amounts of heat transferred to the flame-hole walls that form the reference regions.

For example, when the material and thickness of a pair of rich plates are constant, the rich plates may be designed such that the sum of lengths of upper ends of the pair of rich plates that form reference regions is substantially the same in the reference regions having the same size. That is, the rich plates may be designed such that the sum of the lengths of the pair of rich plates 120 that form the reference region S in FIG. 5 and the sum of the lengths of the pair of rich plates 120' that form the reference region S' are substantially the same as each other. When the sums of the lengths are the same, it may be considered that the areas of the flame-hole walls to which heat is transferred are the same.

When the difference between the sum of the lengths of the upper ends of the pair of rich plates 120 that form the reference region S and the sum of the lengths of the upper ends of the pair of rich plates 120' that form the reference region S' is within an error range of about 15%, the sum of the lengths of the upper ends of the pair of rich plates that form each of the reference regions may be considered to be substantially the same. The lengths of rich plates actually manufactured may have a tolerance with design lengths, and even though there is a difference in the sum of the lengths of the upper ends of the pair of rich plates that form the reference regions, the sum of the lengths of the upper ends of the pair of rich plates that form the reference regions may be considered to be substantially the same within the tolerance range that occurs during manufacturing.

Accordingly, it may be considered that in each reference region, the limit condition in which lifting occurs is substantially the same and an equivalent flame stabilizing effect appears. Meanwhile, the numerical value of 15% does not have a special meaning and is an example for representing a range of a tolerance level that occurs during manufacturing.

In another example, even though the distances between the pair of rich plates that form the reference regions differ from each other or there is a difference in other properties of the rich plates, the thickness and material of the rich plates may be adjusted such that the amounts of heat transferred to the rich plates are the same.

Meanwhile, referring to FIGS. 3 and 4, the flame-hole structures according to the present disclosure may further include a partitioning part 30. The partitioning part 30 refers to a part that is provided between the lean flame-hole part 10 and the rich flame-hole part 20 and through which the lean gas and the rich gas are not jetted. The partitioning part 30 may be designed such that the lean flame and the rich flame are formed with an appropriate interval therebetween and a flame stabilizing effect most effectively appears.

The partitioning part 30 may not exist in a portion where the lean flame-hole part 10 and the rich flame-hole part 20 are brought into close contact with each other. Between the horizontal portions of the first rich plates 121 and the horizontal portions of the first lean plates 111, the width of the partitioning part 30, that is, the interval between the horizontal portions of the first rich plates 121 and the horizontal portions of the first lean plates 111 along the width direction y may be constant along the lengthwise direction x, and thus the lean flame and the rich flame may be formed with a uniform interval.

Meanwhile, a region in which the rich flame is generated may preferably be decreased to reduce occurrence of NOx. However, in a case of decreasing the size of the rich flame-hole part 20 in which the rich flame is generated, a flame stabilizing effect by the rich flame may be reduced, and therefore flame stability may be deteriorated. Furthermore, in a case where the rich flame-holes 21 are not formed to be narrow, a flame may be formed in a burner, and therefore the durability of the burner may be decreased.

For this reason, the rich flame-holes 21 may be formed to be narrow, and distribution of a flame sensitively reacts to the tolerance of the area of the rich flame-holes 21 depending on assembly. That is, when the burner is assembled, it is necessary to accurately control the area of the rich flame-holes 21.

Figure 6:
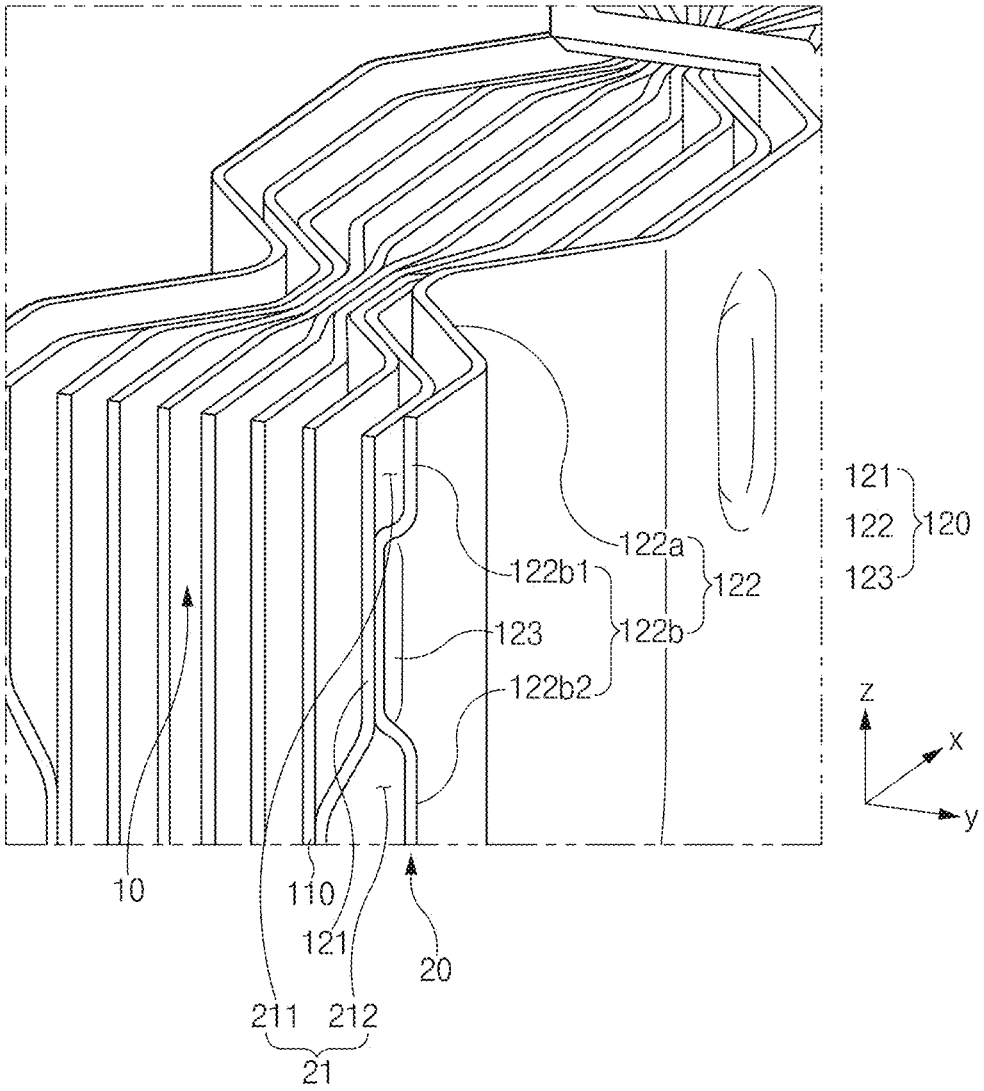
FIG. 6 is a perspective view illustrating a flame-hole structure according to a modified example of the other embodiment of the present disclosure.
Figure 7:
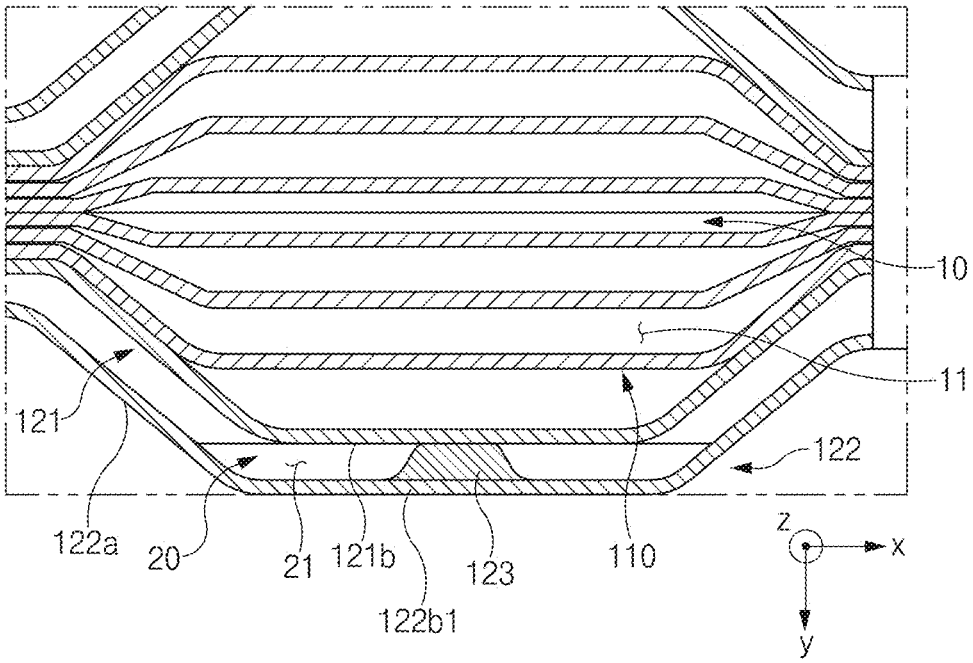
FIG. 7 is a plan view illustrating the flame-hole structure according to the modified example of the other embodiment of the present disclosure.

Hereinafter, a spacing part 123 included in a flame-hole structure according to a modified example of the other embodiment of the present disclosure will be described with reference to FIGS. 6 and 7. The spacing part 123 is a structure employed to maintain the area of the rich flame-hole 21. FIG. 6 is a perspective view illustrating the flame-hole structure according to the modified example of the other embodiment of the present disclosure. FIG. 7 is a plan view illustrating the flame-hole structure according to the modified example of the other embodiment of the present disclosure.

Referring to the drawings, a rich flame-hole part 20 of the flame-hole structure according to the modified example of the other embodiment of the present disclosure includes the spacing part 123. The spacing part 123 is a component disposed in a rich flame-hole 21 to allow the width of the rich flame-hole 21 along a width direction to remain constant in a region of the rich flame-hole 21 that corresponds to a first region.

With respect to the width direction, a plurality of rich plates 120 may be disposed to form the rich flame-hole 21. Among the plurality of rich plates 120, a first rich plate 121 may be disposed in the innermost position with respect to the width direction, and a second rich plate 122 may be disposed in the outermost position with respect to the width direction. The first and second rich plates 121 and 122 may be adjacent to each other.

The rich flame-hole 21 may be formed between the first rich plate 121 and the second rich plate 122. The spacing part 123 may be disposed in the rich flame-hole 21 and may make contact with the adjacent rich plates 120 that form the rich flame-hole 21.

As the spacing part 123 is disposed between the adjacent rich plates 120 and makes contact with the adjacent rich plates 120, the interval between the adjacent rich plates 120 with respect to the width direction may be the same as the width of the spacing part 123. Even if the adjacent rich plates 120 are assembled at an interval smaller than the width of the spacing part 123, the adjacent rich plates 120 do not become closer to each other in as much as the spacing part 123 making contact with the rich plates 120 is not compressed in the width direction.

Accordingly, even in a process of assembling a burner by using a method of pressing the plates against each other, the area of the rich flame-hole 21 may be controlled within a predetermined error range. As the area of the rich flame-hole 21 is controlled within the predetermined error range, the stability of a flame generated in the entire flame-hole structure may be improved.

The position of the spacing part 123 in the modified example of the other embodiment of the present disclosure will be more specifically described. The second rich plate 122 may include a second rich plate protruding-portion 122*a* and a second rich plate horizontal-portion 122*b*. The second rich plate protruding-portion 122*a* and the second rich plate horizontal-portion 122*b* correspond to the rich plate protruding-portion (120*a* of FIG. 4) and the rich plate horizontal-portion (120*b* of FIG. 4) described above with reference to FIG. 4. The spacing part 123 may protrude inward with respect to the width direction from the second rich plate horizontal-portion 122*b* to a first rich horizontal-portion 121*b* and may make contact with the first rich plate horizontal-portion 121*b*.

As the spacing part 123 makes contact with the first rich plate horizontal-portion 121*b* at the same time as protruding from the second rich plate horizontal-portion 122*b*, the spacing part 123 makes contact with the horizontal portions 121*b* and 122*b* of the first rich plate 121 and the second rich plate 122 that are the rich plates 120 adjacent to each other. Alternatively, the spacing part 123 may protrude outward from the first rich plate horizontal-portion 121*b* with respect to the width direction and may make contact with the second rich plate horizontal-portion 122*b*.

The spacing part 123 may be formed like an embossing, by pressing the rich plate 120. Accordingly, in a section obtained by cutting the spacing part 123 with a plane perpendicular to a jetting direction, the profile of the spacing part may be formed in a shape in which the width in a lengthwise direction gradually decreases from the second rich plate 122 toward the first rich plate 121 along the width direction.

According to another modified example, the spacing part may include a first spacing unit (not illustrated) that protrudes outward with respect to the width direction from the first rich plate horizontal-portion 121*b* toward the second rich plate horizontal-portion 122*b* and a second spacing unit (not illustrated) that protrudes inward from the second rich plate horizontal-portion 122*b* toward the first rich plate horizontal-portion 121*b*. The first spacing unit and the second spacing unit may make contact with each other to form a state in which the spacing part makes contact with the first rich plate 121 and the second rich plate 122.

The spacing part 123 may be disposed to be spaced apart from a distal end of one rich plate 120 in an opposite direction to the jetting direction. The position of the spacing part 123 on the rich plate 120 with respect to the jetting direction may be appropriately changed depending on the type of burner.

The rich flame-hole 21 may include a downstream rich flame-hole 211 located downstream of the spacing part 123 with respect to the jetting direction and formed such that rich gas split by the spacing part 123 is gathered and jetted, and an upstream rich flame-hole 212 located upstream of the spacing part 123. The downstream rich flame-hole 211 may be formed between a second rich plate downstream-side horizontal portion 122*b*1 located downstream of the spacing part 123 and the first rich plate horizontal-portion 121*b*, and the upstream rich flame-hole 212 may be formed between a second rich plate upstream-side horizontal-portion 122*b*2 located upstream of the spacing part 123 and the first rich plate horizontal-portion 121*b*.

The rich gas flowing in the upstream rich flame-hole 212 along the jetting direction is split by the spacing part 123. The split rich gas flows around the spacing part 123 and meets in the downstream rich flame-hole 211 again. As the rich gas is gathered in the downstream rich flame-hole 211, an integrated rich flame not separated may be formed in the rich flame-hole 21. Accordingly, the stability of the rich flame may be improved.

The spacing part 123 may be formed such that the width in the jetting direction is greater than the width in the lengthwise direction. Accordingly, the area of the spacing part 123 may be sufficiently ensured while a reduction in the cross-sectional area of the rich flame-hole 21 in which the rich gas flows is minimized. Thus, the spacing part 123 may stably support the rich plates 120 adjacent to each other and may maintain the interval between the rich plates 120.

Here, "constant" does not mean "numerically constant", but means consistency to a degree that substantially the same effect is achieved in the art to which the present disclosure pertains.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims. Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

The invention claimed is:

1. A flame-hole structure of a combustion apparatus, wherein the flame-hole structure has a plurality of flame-holes for forming a flame, the flame-hole structure comprising:

a lean flame-hole part having a plurality of lean flame-holes arranged along a width direction perpendicular to a jetting direction of lean gas as flame-holes through which the lean gas is jetted; and a rich flame-hole part having a pair of rich flame-holes provided on opposite sides of the lean flame-hole part with respect to the width direction as flame-holes through which rich gas is jetted, wherein the lean flame-hole part includes a first region in which widths of the lean flame-holes along the width direction are constant along a lengthwise direction perpendicular to the jetting direction and the width direction and second regions provided on opposite sides of the first region along the lengthwise direction, the widths of the lean flame-holes along the width direction being narrower in the second regions than in the first region, wherein the lean flame-hole part and the rich flame-hole part are brought into close contact with each other in at least part of the second regions wherein the lean flame-hole part further includes a plurality of lean plates disposed to be spaced apart from each other at a predetermined interval while facing each other along the width direction, and the lean flame-holes are formed in separation spaces between the lean plates, wherein the rich flame-hole part further includes a plurality of rich plates disposed to be spaced apart from each other at a predetermined interval while facing each other along the width direction, and the rich flame-holes are formed in separation spaces between the rich plates, wherein the plurality of lean plates include a bending portion bent toward the center of the lean flame-hole part along the width direction to form the second regions and lean plate horizontal-portions extending from opposite ends of the bending portion along a direction parallel to the lengthwise direction, wherein the plurality of rich plates include a protruding portion protruding toward the bending portion to correspond to the bending portion and rich plate horizontal-portions extending from opposite ends of the protruding portion along the direction parallel to the lengthwise direction, wherein a protruding portion of a first rich plate located in the innermost position with respect to the width direction among the plurality of rich plates is brought into close contact with at least part of a bending portion of a first lean plate located in the outermost position with respect to the width direction among the plurality of lean plates, wherein the protruding portion of the first rich plate includes a first inclined surface and a second inclined surface extending from the adjacent rich plate horizontal-portions so as to be inclined toward the center of the lean flame-hole part along the width direction and a first horizontal surface extending along the direction parallel to the lengthwise direction to connect distal ends of the first inclined surface and the second inclined surface, wherein the bending portion of the first lean plate includes a third inclined surface and a fourth inclined surface extending from the adjacent lean plate horizontal-portions so as to be inclined toward the center of the lean flame-hole part along the width direction and a second horizontal surface extending along the lengthwise direction to connect distal ends of the third inclined surface and the fourth inclined surface, and wherein the first horizontal surface is brought into contact with the second horizontal surface.

2. The flame-hole structure of claim 1, wherein a protruding portion of a first rich plate located in the innermost position with respect to the width direction among the plurality of rich plates is brought into close contact with the entirety of a bending portion of a first lean plate located in the outermost position with respect to the width direction among the plurality of lean plates.

3. The flame-hole structure of claim 2, wherein the protruding portion of the first rich plate includes a first inclined surface and a second inclined surface extending from the adjacent rich plate horizontal-portions so as to be inclined toward the center of the lean flame-hole part along the width direction and a first horizontal surface extending along the lengthwise direction to connect distal ends of the first inclined surface and the second inclined surface, wherein the bending portion of the first lean plate includes a third inclined surface and a fourth inclined surface extending from the adjacent lean plate horizontal-portions so as to be inclined toward the center of the lean flame-hole part along the width direction and a second horizontal surface extending along the lengthwise direction to connect distal ends of the third inclined surface and the fourth inclined surface, and wherein the first inclined surface is brought into close contact with the third inclined surface, the second inclined surface is brought into close contact with the fourth inclined surface, and the first horizontal surface is brought into close contact with the second horizontal surface.

4. A flame-hole structure of a combustion apparatus, wherein the flame-hole structure has a plurality of flame-holes for forming a flame, the flame-hole structure comprising:

a lean flame-hole part having a plurality of lean flame-holes arranged along a width direction perpendicular to a jetting direction of lean gas as flame-holes through which the lean gas is jetted, and a rich flame-hole part having a pair of rich flame-holes provided on opposite sides of the lean flame-hole part with respect to the width direction as flame-holes through which rich gas is jetted, wherein the lean flame-hole part includes a first region in which widths of the lean flame-holes along the width direction are constant along a lengthwise direction perpendicular to the jetting direction and the width direction and second regions provided on opposite sides of the first region along the lengthwise direction, the widths of the lean flame-holes along the width direction being narrower in the second regions than in the first region, wherein the lean flame-hole part and the rich flame-hole part are brought into close contact with each other in at least part of the second regions, wherein the lean flame-hole part further includes a plurality of lean plates disposed to be spaced apart from each other at a predetermined interval while facing each other along the width direction, and the lean flame-holes are formed in separation spaces between the lean plates, wherein the rich flame-hole part further includes a plurality of rich plates disposed to be spaced apart from each other at a predetermined interval while facing each other along the width direction, and the rich flame-holes are formed in separation spaces between the rich plates, wherein the plurality of lean plates include a bending portion bent toward the center of the lean flame-hole part along the width direction to form the second regions and lean plate horizontal-portions extending from opposite ends of the bending portion along a direction parallel to the lengthwise direction, wherein the plurality of rich plates include a protruding portion protruding toward the bending portion to correspond to the bending portion and rich plate horizontal-portions extending from opposite ends of the protruding portion along the direction parallel to the lengthwise direction, wherein a reference region refers to a region defined at an upper end of each of the rich flame-holes by first and second lines that are virtual lines across the rich flame-hole and a pair of rich plates configured to form part of the rich flame-hole between the first and second lines, and wherein the plurality of rich plates are designed such that in a region from at least one rich plate horizontal-portion through an adjacent protruding portion of a rich plate to another rich plate horizontal-portion, the sum of amounts of heat transferred to a pair of rich plates configured to form reference regions having the same size is substantially the same in the reference regions when a flame is generated by the rich gas.

5. The flame-hole structure of claim 4, wherein the plurality of rich plates are designed such that the sum of lengths of upper ends of the pair of rich plates configured to form the reference regions is substantially the same in the reference regions having the same size.

6. The flame-hole structure of claim 1, further comprising:

a partitioning part formed between a first lean plate located in the outermost position with respect to the width direction among the plurality of lean plates and a first rich plate located in the innermost position with respect to the width direction among the plurality of rich plates, wherein the lean gas and the rich gas are not jetted through the partitioning part.

7. The flame-hole structure of claim 1, wherein the rich flame-hole part further includes a plurality of rich plates disposed to be spaced apart from each other at a predetermined interval while facing each other along the width direction, wherein the rich flame-holes are formed in separation spaces between the rich plates, and wherein the rich flame-hole part further includes a spacing part disposed in each of the rich flame-holes such that the width of the rich flame-hole along the width direction remains constant in a region of the rich flame-hole corresponding to the first region.

8. The flame-hole structure of claim 7, wherein the spacing part makes contact with adjacent rich plates configured to form the rich flame-hole in which the spacing part is disposed.

9. A flame-hole structure of a combustion apparatus, wherein the flame-hole structure has a plurality of flame-holes for forming a flame, the flame-hole structure comprising:

a lean flame-hole part having a plurality of lean flame-holes arranged along a width direction perpendicular to a jetting direction of lean gas as flame-holes through which the lean gas is jetted, and a rich flame-hole part having a pair of rich flame-holes provided on opposite sides of the lean flame-hole part with respect to the width direction as flame-holes through which rich gas is jetted, wherein the lean flame-hole part includes a first region in which widths of the lean flame-holes along the width direction are constant along a lengthwise direction perpendicular to the jetting direction and the width direction and second regions provided on opposite sides of the first region along the lengthwise direction, the widths of the lean flame-holes along the width direction being narrower in the second regions than in the first region, wherein the lean flame-hole part and the rich flame-hole part are brought into close contact with each other in at least part of the second regions, wherein the rich flame-hole part further includes a plurality of rich plates disposed to be spaced apart from each other at a predetermined interval while facing each other along the width direction, wherein the rich flame-holes are formed in separation spaces between the rich plates, and wherein the rich flame-hole part further includes a spacing part disposed in each of the rich flame-holes such that the width of the rich flame-hole along the width direction remains constant in a region of the rich flame-hole corresponding to the first region, wherein the lean flame-hole part further includes a plurality of lean plates disposed to be spaced apart from each other at a predetermined interval while facing each other along the width direction, wherein the plurality of lean plates include a bending portion bent toward the center of the lean flame-hole part along the width direction to form the second regions and lean plate horizontal-portions extending from opposite ends of the bending portion along a direction parallel to the lengthwise direction, wherein the plurality of rich plates include a protruding portion protruding toward the bending portion to correspond to the bending portion and rich plate horizontal-portions extending from opposite ends of the protruding portion along the direction parallel to the lengthwise direction, and wherein the spacing part makes contact with the rich plate horizontal-portions of the adjacent rich plates.

10. The flame-hole structure of claim 7, wherein the spacing part has a shape protruding from one of the plurality of rich plates toward another rich plate and makes contact with the other rich plate.

11. The flame-hole structure of claim 10, wherein the spacing part has a shape protruding inward with respect to the width direction from a second rich plate located in the outermost position with respect to the width direction among the plurality of rich plates toward a first rich plate located in the innermost position and makes contact with the first rich plate.

12. The flame-hole structure of claim 10, wherein a profile of the spacing part in a section obtained by cutting the spacing part with a plane perpendicular to the jetting direction is formed in a shape in which a width in the lengthwise direction gradually decreases from the one rich plate toward the other rich plate along the width direction.

13. The flame-hole structure of claim 7, wherein the spacing part includes a first spacing unit having a shape protruding outward with respect to the width direction from a first rich plate located in the innermost position with respect to the width direction among the plurality of rich plates toward a second rich plate located in the outermost position and a second spacing unit protruding inward from the second rich plate toward the first rich plate, and wherein the first spacing unit and the second spacing unit make contact with each other.

14. The flame-hole structure of claim 7, wherein in an opposite direction to the jetting direction, the spacing part is spaced apart from a distal end of the rich plate with respect to the jetting direction.

15. The flame-hole structure of claim 14, wherein the rich flame-hole includes a downstream rich flame-hole located downstream of the spacing part with respect to the jetting direction and formed such that the rich gas split by the spacing part is gathered and jetted.

16. The flame-hole structure of claim 7, wherein the spacing part is formed such that a width in the jetting direction is greater than a width in the lengthwise direction.

* * * * *